US012195885B2

(12) United States Patent
Sendler et al.

(10) Patent No.: US 12,195,885 B2
(45) Date of Patent: Jan. 14, 2025

(54) MULTIFUNCTIONAL NOZZLE FOR A SPINNING MACHINE

(71) Applicant: Saurer Spinning Solutions Gmbh & Co. KG, Uebach-Palenberg (DE)

(72) Inventors: Pia Sendler, Stuttgart (DE); Dieter Haberkorn, Uhingen (DE)

(73) Assignee: Saurer Spinning Solutions Gmbh & Co. KG, Übach-Palenberg (DE)

( * ) Notice: Subject to any disclaimer, the term of this patent is extended or adjusted under 35 U.S.C. 154(b) by 10 days.

(21) Appl. No.: 18/254,717

(22) PCT Filed: Dec. 2, 2021

(86) PCT No.: PCT/EP2021/083941
§ 371 (c)(1),
(2) Date: May 26, 2023

(87) PCT Pub. No.: WO2022/128504
PCT Pub. Date: Jun. 23, 2022

(65) Prior Publication Data

US 2024/0026576 A1 Jan. 25, 2024

(30) Foreign Application Priority Data

Dec. 14, 2020 (DE) ..... 10 2020 133 359.5

(51) Int. Cl.
*D01H 1/115* (2006.01)
*D01H 4/02* (2006.01)
(Continued)

(52) U.S. Cl.
CPC ..... *D01H 1/115* (2013.01); *D01H 4/02* (2013.01); *D01H 4/38* (2013.01); *D01H 4/34* (2013.01)

(58) Field of Classification Search
CPC . D01H 1/115; D01H 1/11; D01H 4/38; D01H 4/02; D01H 4/34
See application file for complete search history.

(56) References Cited

U.S. PATENT DOCUMENTS 3,458,987 A * 8/1969 Adachi ..... D02G 3/38 57/328
3,501,907 A 3/1970 Tabata et al.
(Continued)

FOREIGN PATENT DOCUMENTS

CN 209098877 U 7/2019
DE 1115163 10/1961
(Continued)

OTHER PUBLICATIONS

International Search Report, with English translation, issued in corresponding International Application No. PCT/EP2021/083941, date of mailing Apr. 8, 2022 (5 pages).
(Continued)

*Primary Examiner* — Bao-Thieu L Nguyen
(74) *Attorney, Agent, or Firm* — FLYNN THIEL, P.C.

(57) ABSTRACT

A multifunctional nozzle for a spinning machine used to produce real-twist yarn. The multifunctional nozzle comprises a nozzle channel open on one side in a nozzle housing and in which a vortex flow can be generated. A nozzle body which is shorter than the nozzle channel is provided with a through-channel for the passage of a thread or fibre band. An annular gap with a narrow point is formed within the nozzle channel. The annular gap tapering on both sides at the narrow point. The narrow point is arranged downstream of a fluid inlet which leads to the nozzle channel. A hollow body-type flow conducting body is provided between the annular gap and the open end of the nozzle channel for guiding the thread or fibre band together with a fluid, the
(Continued)

Figure 1:
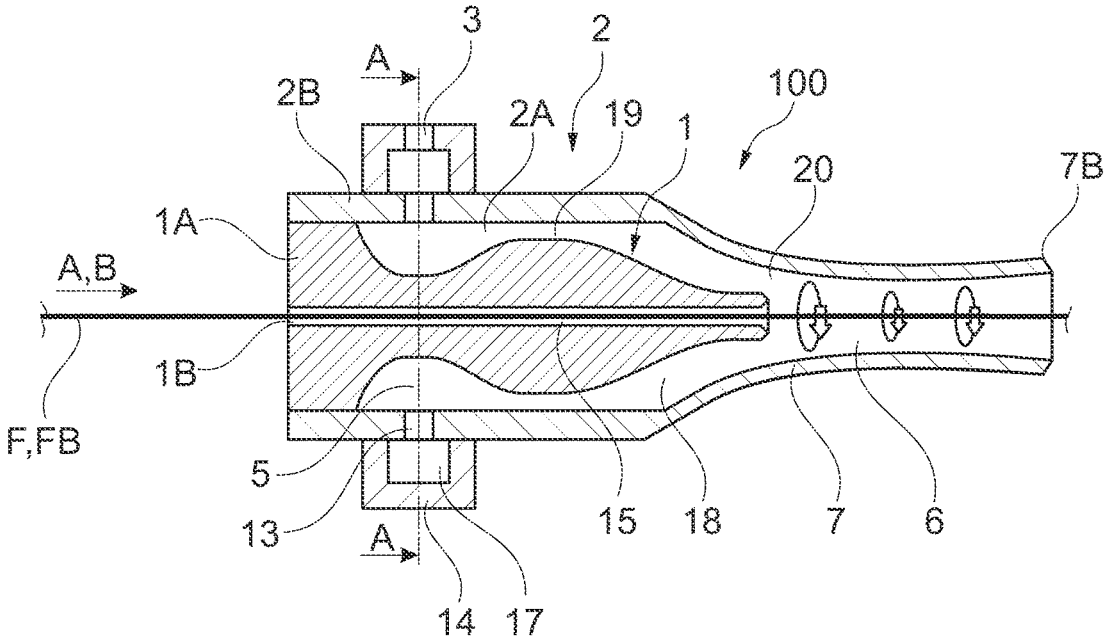

annular gap being formed between the nozzle body and the nozzle housing and/or the flow conducting body.

18 Claims, 5 Drawing Sheets

(51) Int. Cl.
*D01H 4/34* (2006.01)
*D01H 4/38* (2006.01)

(56) References Cited

U.S. PATENT DOCUMENTS 3,583,143 A * 6/1971 Guignard ..... D01H 1/11 57/279
3,604,194 A 9/1971 Edagawa et al.
3,722,198 A * 3/1973 Gotzfried ..... D01H 1/115 57/333
3,742,692 A * 7/1973 Bense ..... D02G 1/04 57/333
3,885,278 A * 5/1975 Whitaker ..... D02G 1/12 28/255
3,910,021 A * 10/1975 Van Petten ..... B65H 73/00 28/295
4,141,121 A * 2/1979 Trifunovic ..... D02G 1/161 57/239
4,319,448 A 3/1982 Jóźwicki et al.
4,444,003 A * 4/1984 Gotzfried ..... D01H 1/115 57/403
4,457,130 A 7/1984 Sakai et al.
4,509,321 A * 4/1985 Kajita ..... D01H 1/115 57/328
4,553,383 A * 11/1985 Didek ..... D01H 4/02 57/403
4,821,505 A * 4/1989 Jacobsen ..... D01H 4/02 57/411
4,932,202 A 6/1990 Landwehrkamp
5,086,615 A 2/1992 Bodnar
5,423,177 A 6/1995 Raasch
5,461,757 A 10/1995 Leifeld
5,934,058 A * 8/1999 Hirao ..... D01H 15/002 57/328
6,035,625 A 3/2000 Schlomer et al.
6,067,786 A 5/2000 Schmid
6,269,623 B1 8/2001 Phoa et al.
6,314,714 B1 11/2001 Feuerlohn et al.
6,347,506 B1 2/2002 Backmeister
6,389,789 B1 5/2002 Preininger et al.
2002/0046558 A1 4/2002 Lovas et al.
2002/0124543 A1* 9/2002 Bischofberger ..... D01H 4/38 57/5
2002/0152739 A1* 10/2002 Anderegg ..... D01H 1/115 57/333
2003/0115850 A1 6/2003 Stalder et al.
2003/0121247 A1 7/2003 Stalder et al.
2004/0261391 A1 12/2004 Stalder et al.
2005/0011178 A1 1/2005 Weide et al.
2005/0229580 A1 10/2005 Baur
2005/0233021 A1 10/2005 Chun et al.
2009/0094958 A1* 4/2009 Weide ..... D01H 1/115 57/328
2011/0315265 A1 12/2011 Schermer et al.
2015/0337463 A1 11/2015 Stahlecker et al.
2016/0010245 A1 1/2016 Stahlecker et al.
2016/0376731 A1 12/2016 Winzen
2017/0314166 A1* 11/2017 D'Agnolo ..... D01H 1/115
2017/0342605 A1 11/2017 Loos et al.
2018/0030624 A1 2/2018 Baier et al.
2018/0320292 A1 11/2018 Baur et al.
2018/0320293 A1 11/2018 Baur et al.
2019/0100861 A1 4/2019 Maleck et al.
2020/0131673 A1* 4/2020 D'Agnolo ..... D01H 4/02
2021/0198810 A1 7/2021 Lozano et al.
2022/0195634 A1 6/2022 Meissner et al.
2023/0016597 A1* 1/2023 Günther ..... D01H 5/005
2023/0115870 A1* 4/2023 Kistner ..... D01H 4/34 57/350
2023/0392299 A1 12/2023 Jakobinski et al.
2023/0407530 A1 12/2023 Chen et al.
2024/0026577 A1 1/2024 Dressen et al.

FOREIGN PATENT DOCUMENTS

DE 2304190 10/1973
DE 3237990 A1 8/1983
DE 3913215 A1 11/1989
DE 102008006379 A1 7/2009
EP 2677070 A1 12/2013
EP 3012362 A2 4/2016
JP S58-81625 A 5/1983

OTHER PUBLICATIONS

Written Opinion of the International Searching Authority issued in corresponding International Application No. PCT/EP2021/083941, date of mailing Apr. 8, 2022 (6 pages).
Search Report, with English translation, issued in corresponding German Application No. 10 2020 133 359.5, date of mailing Oct. 15, 2021 (10 pages).

* cited by examiner

MULTIFUNCTIONAL NOZZLE FOR A SPINNING MACHINE

The present invention relates to a multifunctional nozzle for a spinning machine, said nozzle being usable for a spinning device, for a spinning method and for fibre material compression.

Various types of spinning machine having corresponding spinning devices, spinning methods and compression apparatuses have long been known in the prior art. For instance, using ring spinning methods on ring spinning machines, in particular by means of a compacting device, compressed or compacted threads are produced that, due to their real twist, have high strength, high elongation, high uniformity and high hairiness and cover a large fineness range, but these can only be produced at low spinning speeds due to physical limits. The physical limits in this context are down to ballooning force limitations, ring traveller system limitations and yarn strength limitations.

Another known spinning method is the rotor spinning method on rotor spinning machines, which is based on the open-end (OE) principle. Under the OE principle, fibres that have been separated beforehand by means of fibre opening accumulate at an open thread end provided in the spinning rotor and are bound-in onto the open thread end during the twisting conferred by the rotation of the spinning rotor. Compared with ring yarns, i.e. the threads produced by means of ring spinning methods, threads produced in this way, which are also known as rotor yarns, have better uniformity and lower hairiness and require lower production costs, but they have poorer yarn strength and flexural strength. For process reasons, so-called belly bands and wrap fibres occur in rotor yarns, and these give the rotor yarn a characteristic appearance and feel but are not desirable in all textile applications. In particular, the number of belly bands influences the yarn quality in terms of strength, flexural strength and feel. The number of belly bands generally increases both at higher rotational speeds of the spinning rotors and as the spinning rotor diameter becomes smaller. Compared with ring yarns, rotor yarns can also only cover a limited yarn fineness range.

The single-nozzle air spinning process that is likewise known is a real-twist air spinning process in which a fibre band having largely parallel fibres that has been drawn beforehand in a defined manner in a drafting system device is air-spun, by means of a vortex air flow generated in an air spinning nozzle, around a yarn forming element to form a thread. In the air spinning process, individual fibres are laid helically around fibres, which are oriented in parallel with one another and form a yarn core, in the spinning nozzle by means of the vortex air flow. The fibres are medium-length to long fibres. Short fibres, on the other hand, are largely blown out and cannot be reliably processed. Compared with ring yarns, the yarn produced in this manner has poorer yarn strength and uniformity and, like rotor yarns, can only cover a limited yarn fineness range, but it does have lower hairiness and can be produced with lower production costs and at higher spinning speeds than in the ring spinning method.

Yarns produced by means of various spinning methods all share the characteristic that they each come with specific advantages and also with specific disadvantages in terms of the yarn parameters, production costs and productivity.

The aim of the present invention is to make it possible to produce at least one alternative, in particular improved, real twist yarn for a wide field of application, said yarn further preferably being able to do without a core of untwisted, in particular parallel, fibres. Further preferably, as a result of the provided possibility, a yarn is to be created in which advantages of an open-end yarn can be combined, at least in part, with those of a ring yarn.

For this purpose, the present invention proposes a multifunctional nozzle for a spinning machine, said multifunctional nozzle having a nozzle housing, to which pressure can be applied and which has a nozzle channel, which extends along the longitudinal axis direction of the nozzle housing and is open on one side along the longitudinal axis direction. On the side facing away from the open side, the nozzle channel can be closed by a means or by the nozzle housing itself, in each case while forming a through-duct that connects the nozzle channel to the surroundings, as will be explained in more detail below.

In the context of the present invention, a longitudinal axis direction should be understood as the direction of a component, a unit, an apparatus or a device that, in terms of magnitude, has a greater physical extension length compared with an axis orthogonal thereto.

The nozzle housing is a geometric hollow body, the cavity in which forms the nozzle channel. Preferably, the nozzle housing can have a circular, rectangular, polygonal or oval cross section orthogonally to its longitudinal axis direction, and can be made of a metal-containing, plastics-containing or ceramic material, or of a combination of these or other materials, such as silica sand. The wall of the nozzle housing has a thickness and/or material composition that allow(s) it to withstand an ongoing application of pressure by a fluid, as is necessary for operating the multifunctional nozzle.

In addition, the multifunctional nozzle has a fluid inlet, by means of which a pressurised fluid can be admitted into the nozzle channel to bring about a vortex flow within the nozzle channel. The fluid inlet is preferably formed on the nozzle housing by an opening that opens into the nozzle channel. Alternatively or additionally, a fluid inlet can be embodied in a component, separate from the nozzle housing, for admitting the fluid into the nozzle channel, the component being able to be inserted, for example via an opening in the nozzle housing, into said opening and, as applicable, into the nozzle channel.

According to a preferred embodiment, the fluid inlet is arranged inside a pressure chamber of an antechamber housing for the fluid feed. The antechamber housing can be arranged on the nozzle housing in order to keep the structure simple and compact. Further preferably, the antechamber housing can extend circumferentially around the nozzle housing, which is particularly advantageous if more than one fluid inlet is provided, in order to supply the pressurised fluid to this number of fluid inlets simultaneously via the pressure chamber. For example, the antechamber housing having the pressure chamber can extend annularly around the nozzle housing either in part or entirely.

The fluid inlet is configured to generate a vortex flow in the through-duct. For this purpose, the fluid inlet can preferably have at least one fluid inlet mouth having a mouth axis which points in a circumferential direction of the nozzle channel, in particular tangentially thereto. In a preferred alternative or additional manner, the fluid inlet has two or more than two fluid inlet mouths, which lead into the nozzle channel, are distributed circumferentially around the nozzle channel and open into the nozzle channel to generate the vortex flow. Further preferably, the fluid inlet mouths are arranged in an orthogonal plane in relation to the longitudinal axis direction and particularly preferably admit the pressurised fluid tangentially to the nozzle channel. Further preferably, a tangentially oriented mouth axis of at least one fluid inlet mouth can point in a direction facing the open end of the nozzle channel while forming an angle of more than 0° and less than 90° with the orthogonal plane, thereby making it possible to generate an improved vortex flow having reduced turbulence flows.

Preferably, the fluid is a gaseous fluid; further preferably, the fluid is air, such as ambient air, or a mixture of at least two gaseous fluids. A mixture of a gaseous and a liquid fluid is also conceivable. A mixture of this kind is suitable in particular for a predefined treatment of the thread or of the fibre band and/or of the surfaces of the multifunctional nozzle that are in contact with the thread or fibre band, for example to reduce deposits or finishing agents on these surfaces.

The multifunctional nozzle further comprises a nozzle body for arrangement in the nozzle channel. The nozzle body is accordingly configured to be able to be arranged in the nozzle channel, in particular interchangeably. The external shape of the nozzle body is such that the nozzle body can be formed in the nozzle channel together with the nozzle housing, or arranged and/or inserted in the nozzle channel.

The nozzle body comprises a through-duct, which extends along the longitudinal axis direction, for guiding through a thread or fibre band. The cross section of the through-duct is suitably adapted, depending on the cross section of the thread or fibre band being guided therethrough, to be able to guide the thread or fibre band through the nozzle body. Preferably, the internal diameter of the through-duct is adapted to the outer diameter of the thread or fibre band being guided therethrough by being at least 3% and at most 25% larger in order to ensure efficient and in particular unimpeded guidance of the thread or fibre band.

The nozzle body is shorter than the nozzle channel along the longitudinal axis direction so as to be able to guide the admitted pressurised fluid in the nozzle channel past a free end of the nozzle body, thereby making it possible to generate a suction flow in the through-duct.

In addition, the multifunctional nozzle is equipped with an annular gap, which extends in the nozzle channel along the longitudinal axis direction and has at least one narrow point, towards which the annular gap tapers on both sides along the longitudinal axis direction, the narrow point being formed downstream of the fluid inlet along the longitudinal axis direction. Along the longitudinal axis direction, the annular gap can preferably have a cross-sectional shape similar to one or several nozzles, a narrow point being formed by said shape. In the context of the present invention, a cross-sectional shape similar to a nozzle should be understood to be a shape that has a converging cross section towards a narrowest cross section in a longitudinal axis direction.

According to a further preferred embodiment, the annular gap is arranged, in cross section, out of a combination of a cross-sectional shape similar to a nozzle and one similar to a diffuser, having the narrow point between the nozzle-like cross section and the diffuser-like cross section. In the context of the present invention, a cross-sectional shape similar to a diffuser should be understood to be a shape that has a diverging cross section after a narrow point in a longitudinal axis direction. Preferably, the nozzle-like and/or diffuser-like cross-sectional shape is symmetrical in relation to one of the central axes thereof. Further preferably, the cross-sectional shape is similar to a Laval nozzle, by means of which a supersonic flow can be obtained in the diverging part.

In addition, the multifunctional nozzle additionally has an in particular interchangeable delimiting part for arrangement in the nozzle channel, in a manner closing the nozzle housing on one side along the longitudinal axis direction and thus delimiting the nozzle channel on one side along the longitudinal axis direction, on a fluid-inlet side that faces away from the narrow point. The delimiting part is provided for closing the nozzle channel remotely from the fluid inlet, further preferably adjacently to the fluid inlet. The delimiting part has a further through-duct, extending along the longitudinal axis direction, for the thread or fibre band for communicating with the through-duct of the nozzle body. The further through-duct can in particular have an embodiment as described above in relation to the through-duct. Further preferably, the further through-duct and the through-duct are arranged coaxially, further preferably having an identical cross-sectional shape, along the longitudinal axis direction. Preferably, the delimiting part forms a component part of the nozzle body, or a component that is separate from the nozzle body and further preferably formed in one piece with the nozzle housing, or, alternatively, preferably a component that is separate from the nozzle body and nozzle housing and on which the nozzle body is in particular directly arranged or arrangeable such that the further through-duct merges directly into the through-duct and, particularly preferably, bears the nozzle body by means of an integral bond, a frictional connection or interlocking. Alternatively, a connection duct for connecting the further through-duct to the through-duct can preferably be arranged between the further through-duct and the through-duct. In this case, the nozzle body can particularly preferably be borne in the nozzle channel by the connection duct or by means of retaining ribs that connect the nozzle body to the nozzle housing.

The multifunctional nozzle further comprises a hollow-body-like flow conducting body for guiding the thread or fibre band, in a manner accompanied by fluid, between the annular gap and the open end of the nozzle channel. The flow conducting body can preferably be formed by a wall of the nozzle housing or, alternatively or additionally, by a further hollow body. A fixed end of a further hollow-body-like flow conducting body of this kind is preferably coupled to the nozzle housing, the coupling site of the fixed end on the nozzle housing being spaced apart from the open longitudinal end of the nozzle channel. The coupling can be carried out in many different ways and depending on requirements. For example, the coupling can be carried out by means of an integral connection between the nozzle housing and the flow conducting body, for example an adhesive bond. Alternatively or additionally, the fixed end can be latched, screwed, clamped or otherwise frictionally or interlockingly coupled to the nozzle housing. For example, the fixed end of the flow conducting body can be formed so as to be resiliently deformable having a latching means, such as a latching recess and/or a latching protrusion, configured for latching to an associated mating latching means on the wall of the nozzle housing within the nozzle channel. In this way, the fixed end of the flow conducting body could be inserted into the nozzle channel in a resiliently preloaded manner and pushed as far as to the mating latching means while retaining the resilient preload, which at least partly releases at the site of the mating latching means such that latching can take place.

In addition to its fixed end, this kind of preferred further flow conducting body has a free end that is arranged on the fixed-end side that faces away from the delimiting part, having an outer diameter that is smaller than the internal diameter of the nozzle housing at the site of the first narrow point or smaller than the outer diameter of the first narrow point. The free end of the further flow conducting body simultaneously defines and delimits the open end of the nozzle channel due to the formation of at least one terminal part-segment of the nozzle channel.

The flow conducting body can in particular have a cross-sectional shape as described above in relation to the nozzle housing and be made, for example, of a material as described above in relation to the nozzle housing. Particularly preferably, the flow conducting body has a segment having a nozzle-like cross-sectional shape and a diffuser-like cross-sectional shape, more preferably a cross-sectional shape similar to a Laval nozzle, the segment extending between the annular gap and the open end of the nozzle channel.

The annular gap is formed between the nozzle body and the nozzle housing and/or between the nozzle body and the flow conducting body. The annular gap is thus defined by a clearance or gap formed between the outside of the nozzle body and an inside of the nozzle housing or an inside of the flow conducting body. The gap width, i.e. the straight-line distance between the outside of the nozzle body and the inside of the nozzle housing or of the flow conducting body in a cross-sectional plane orthogonal to the longitudinal axis direction, decreases in accordance with the nozzle-like cross-sectional shape up to the narrow point, in particular constantly or in intervals, and then increases again, in particular constantly or in intervals. The spaces between the intervals can preferably be selected depending on requirements. Further preferably, the nozzle body can have a cross-sectional shape similar to a candle flame, further preferably a cross-sectional shape that is symmetrical, in particular rotationally symmetrical, in relation to the central longitudinal axis, in a sectional plane running through the central longitudinal axis of the passage thereof.

According to a further preferred embodiment, along the longitudinal axis direction the annular gap has a second narrow point, which follows the narrow point that defines the first narrow point, at the level of free end or at the free end of the nozzle body in the nozzle housing or inside the flow conducting body. As a result, the flow rate can be increased again in the annular-gap segment that converges towards the second narrow point, in order to be able to bring about a defined suction flow effect in the through-duct of the nozzle body.

The multifunctional nozzle according to the present invention makes it possible to generate a vortex flow that propagates helically around the nozzle body in the annular gap along the longitudinal axis direction and, when it passes the annular-gap end at the free end of the nozzle body, acts on the thread or fibre band being guided through by the nozzle body in such a way that a rotation can be imposed on the thread or fibre band about its longitudinal axis along the longitudinal axis direction.

According to a preferred embodiment, the multifunctional nozzle has a fibre feed for feeding separated fibres, the fibre feed comprising a fibre inlet and a fibre duct that communicates therewith and is arranged downstream thereof in the fibre transport direction.

In addition, the multifunctional nozzle comprises a spinning chamber arranged downstream of the flow conducting body along the longitudinal axis direction, the flow conducting body and the fibre duct opening into the spinning chamber along the longitudinal axis direction. Separately from the mouth of the flow conducting body and of the fibre duct, the spinning chamber has a fibre outlet for discharging superfluous fibres, the fibre outlet being able to be connected to a vacuum source.

According to this preferred embodiment, the multifunctional nozzle forms an alternative spinning device by means of which it is possible to produce a real-twist thread without an untwisted core consisting of parallel fibres. For this purpose, according to a preferred embodiment, a pressurised fluid is admitted into the nozzle channel or into the annular gap via the fluid inlet and is pushed towards the spinning chamber by means of the delimiting part as a result of the nozzle channel being closed on one side. The specific configuration of the fluid inlet brings about a vortex flow within the nozzle channel or annular gap. The pressurised fluid is thus pushed helically around the nozzle body towards the spinning chamber. The in particular Laval nozzle-like cross-sectional change in the annular gap brings about an axially accelerated vortex flow as far as to the free end of the nozzle body or as far as to an annular-gap exit at the level of the free end of the nozzle body. The circulatory flow or the vortex flow generates a vacuum or a suction flow at the outlet of the through-duct, by means of which a thread end inserted into the through-duct can be conveyed into the nozzle channel region that is delimited by the flow conducting body. As a result of the vortex flow, the thread end undergoes a rotational movement about its longitudinal axis and about the longitudinal axis of the through-duct and of the flow conducting body. A vacuum is preferably applied to the fibre outlet of the spinning chamber in order, further preferably, to assist conveyance of the rotating thread end into the spinning chamber. The vortex flow prevailing in the flow conducting body and reaching as far as into the spinning chamber brings about a vacuum or a further suction flow in the fibre feed or in the fibre duct and the fibre inlet. Further preferably, this suction flow is reinforced by means of the vacuum applied to the spinning chamber. As a result, by means of the fibre feed, for example, separated fibres that have been opened by an opening unit known from the open-end rotor spinning method can be sucked into the fibre duct via the fibre inlet and brought into the spinning chamber. The separated fibres come into contact with the rotating thread end in the spinning chamber, as a result of which the separated fibres are aggregated to the rotating open thread end and bound-in. Superfluous separated fibres can be blown out via the fibre outlet or sucked away out of the spinning chamber by means of the vacuum applied to the fibre outlet, thereby making it possible to prevent the spinning chamber from becoming blocked. Further preferably, during the aggregation and binding-in of the separated fibres at the thread end, which take place continuously during the spinning process, the thread is drawn out of the multifunctional nozzle, in the opposite direction to the insertion direction, by means of a thread take-up device at a defined take-off speed.

By making use of the OE principle, under which separated fibres are aggregated and bound-in at an open thread end to form the thread, the multifunctional nozzle according to this preferred embodiment makes it possible to produce an air-spun thread that has a real twist and no untwisted parallel fibres. Unlike the open-end rotor spinning method, in which the separated fibres are aggregated and bound-in by means of a rotating spinning rotor, the multifunctional nozzle according to this preferred embodiment is based on the principle of annular-flow spinning, in which, by generating an annular flow, i.e. a vortex flow as described above, the separated fibres are aggregated and bound-in at the thread end to form the thread solely by means of the generated annular flow. A thread produced in this way additionally has the advantage of being practically to entirely free from disruptive belly bands and/or wrap fibres. The yarn thus produced is suitable for a wider range of applications than the rotor yarn. In addition, the thread can be produced at higher spinning speeds compared with ring spinning methods. As a result, by means of the present invention a real-twist thread that combines at least some of the advantages of a rotor yarn with some of those of a ring yarn can be provided.

According to a preferred embodiment, the physical extension length of the spinning chamber along the longitudinal axis direction is tailored to the fibre length of the fibres to be processed. Further preferably, the spinning chamber is formed by the nozzle housing or by a spinning-chamber housing, which can be coupled to and decoupled from the nozzle housing interchangeably, i.e. non-destructively. The interchangeable coupling of the spinning chamber to the multifunctional nozzle makes it possible to easily adapt the multifunctional nozzle to different fibre lengths to be processed, in order to generate the defined air-spun real-twist thread. For instance, depending on the fibre length to be processed, a spinning chamber tailored to that fibre length can be coupled to the multifunctional nozzle.

According to a further preferred embodiment, the flow conducting body forms a partition wall between the nozzle channel and the fibre duct. In other words, the fibre duct is preferably formed on a side of the flow conducting body that faces away from the nozzle channel. Further preferably, the fibre duct can be formed radially on the inside by the flow conducting body and radially on the outside by a wall of the nozzle housing formed at a spacing from the flow conducting body, this wall extending along the longitudinal axis direction, in particular starting from the fixed end of the flow conducting body, together with the flow conducting body so as to form the fibre duct. Particularly preferably, the wall providing delimiting radially on the outside protrudes beyond the flow conducting body towards the spinning chamber, and further preferably is in the form of a coupling member for interchangeably coupling the spinning-chamber housing to the nozzle housing. The configuration of the multifunctional nozzle can thus be simplified and compact.

Along its longitudinal axis, the spinning chamber preferably has a cross-sectional shape similar to one or several Laval nozzles. As a result, the suction flow effect for sucking the separated fibres and the thread end into the spinning chamber can be favourably assisted.

Further preferably, the spinning chamber can be formed by a hose-like flexible structure. In this way, the spinning chamber can be interchangeably coupled to the nozzle housing in a simple manner, for example by being pushed over it. In addition, the spinning chamber can be cost-effectively produced.

Preferably, the spinning chamber can have a cross-sectional shape similar to a rotor cup interior along the longitudinal axis direction, having an internal diameter along which the mouths of the flow conducting body, of the fibre duct and of the fibre outlet are arranged for communicating with the spinning chamber, the mouths being able to be arranged on the same side or different sides. As a result, known rotor cup geometries can be used in a cost-effective manner. Further preferably, the mouth of the flow conducting body is arranged radially internally along the internal diameter and has a circular cross section, the mouth of the fibre outlet is arranged radially externally and has an cross section similar to an annular gap surrounding the mouth of the flow conducting body, and the mouth of the fibre outlet is arranged therebetween in the radial direction, having either a circular cross section or a cross section similar to an annular gap surrounding the mouth of the flow conducting body. The spinning chamber can thus be formed in a simple and compact manner.

As a further alternative, according to a preferred embodiment the multifunctional nozzle can be used as a spinning device at a workstation of a spinning machine for spinning a real-twist thread, in particular in a ring spinning machine. The workstation has a conventional drafting system device for the defined drawing of a fibre band fed to the drafting system device, and a drivable spindle for bearing an empty tube in a manner rotatably entrained therewith, the spindle having the empty tube being rotatably borne by a spindle rail, which is designed to execute a linear stroke movement back and forth along the axis of rotation of the spindle or empty tube while entraining the spindle having the empty tube. Furthermore, the workstation comprises a delimiting sleeve, which is arranged in a stationary manner and has a cavity, in which the empty tube borne by the spindle is at least partly received in an upward end position of the stroke movement. The multifunctional nozzle in the form of a spinning device is arranged between the drafting system and the delimiting sleeve in the fibre band transport direction. The fibre band, which has been drawn in a defined manner, coming from the drafting system is received by the multifunctional nozzle, guided through the through-ducts of the delimiting part and of the nozzle body and spun into a thread in the region of the flow conducting body by means of the applied vortex flow, said thread being conducted out of the flow conducting body towards the spindle, in a manner accompanied by the vortex flow, by being transferred into the cavity in the delimiting sleeve. The spindle is rotated, in particular in a manner correlated with the vortex flow active in the multifunctional nozzle, in order to wind up the empty tube, and is moved back and forth in a defined manner relative to the delimiting sleeve by means of the stroke movement in order to perform a defined winding of the empty tube along its longitudinal axis in the winding region. The correlated rotation favours precise deposition of the thread in the winding region of the empty tube or the winding of the empty tube along its longitudinal axis. In terms of the preferred embodiment of the workstation of a ring spinning machine, the multifunctional nozzle in conjunction with the delimiting sleeve advantageously replaces the conventional ring traveller system. The replacement makes it possible to eliminate the physical limits of the ring traveller system, in which case, alternatively, a real-twist thread can be produced at higher spinning speeds, the empty tube can be wound up more quickly and, consequently, productivity can also be increased.

According to a further preferred embodiment, the twist generated by means of the multifunctional nozzle and in particular acting on the guided fibre band also makes it possible to compact the fibre material being guided. According to a further preferred aspect of the present invention, the multifunctional nozzle can thus be arranged in a fibre band travel path upstream, in the fibre band transport direction, of a roller pair of a drafting system device, in particular a drafting system device for a ring spinning, air spinning or flyer machine, the drafting system device having at least two roller pairs that are drivable at different rotational speeds from one another for drawing the fibre band being guided via the roller pairs, thereby defining a drafting zone between said roller pairs during operation of the drafting system device. The fibre band being guided through the multifunctional nozzle undergoes a false spin, in particular along with a drawing effect when arranged between the two roller pairs during operation of the drafting system device; the false spin is formed between the clamping regions of the roller pairs in the fibre band transport direction and increasingly strengthens in the fibre band transport direction. The fibre band composite can be reliably compressed by means of the active twist, since any edge fibres sticking out can be readily bound into the fibre band composite and the fibre band composite undergoes efficient tapering or compacting in its width direction.

Therefore, as a result of the present invention, a means is provided that is suitable for different textile machine types, in particular for different spinning machine types, and by means of which yarn parameters such as hairiness, strength, stiffness and feel can be favourably influenced depending on the type of use, and yarn structures having advantages of an open-end spinning yarn can be combined with advantages of a ring yarn. According to a preferred embodiment, to simplify the design further, the multifunctional nozzle or some of its components, the spinning chamber and/or the delimiting sleeve can preferably be formed so as to be rotationally symmetrical in relation to their central axis running along the longitudinal axis direction.

The above-described uses of the multifunctional nozzle are examples. In particular, the multifunctional nozzle can be used in other textile machine types, for example a card, drawframe or flyer, and particularly in combination with the drafting system devices thereof, in a manner described above by way of example.

Further features and advantages of the present invention will become clear from the following description of preferred embodiment examples, on the basis of the figures and drawings illustrating details essential to the present invention, and from the claims. The individual features can be implemented individually or in any desired combination in a preferred embodiment of the present invention.

The present invention will be explained in greater detail below on the basis of embodiment examples shown in the drawings.

IN THE DRAWINGS

Figure 2:
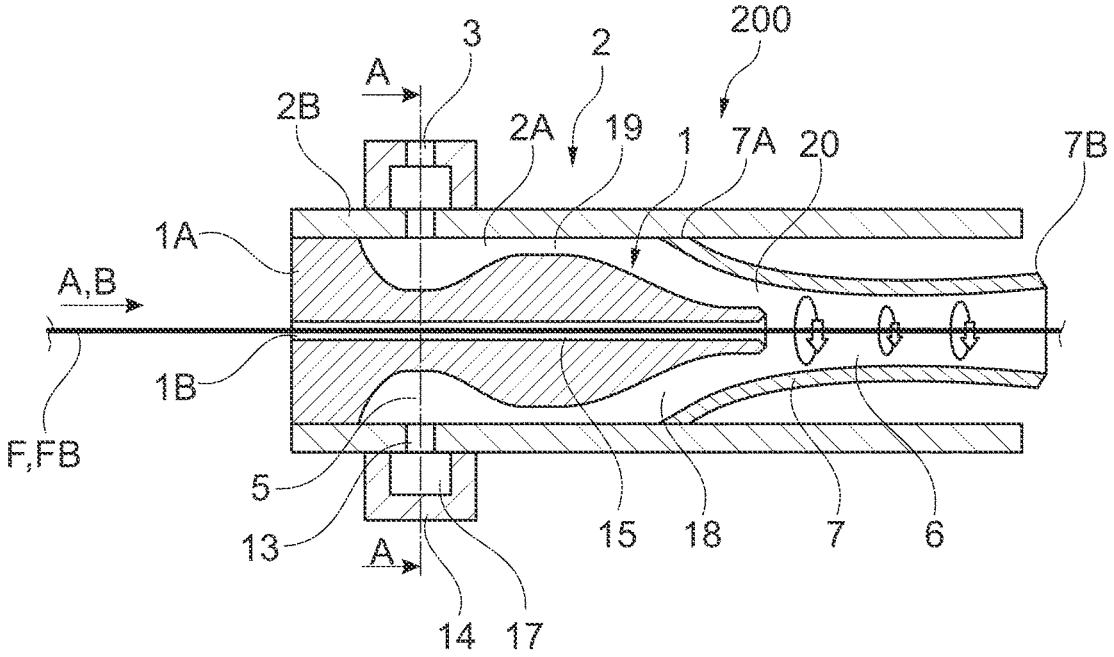
Figure 3:
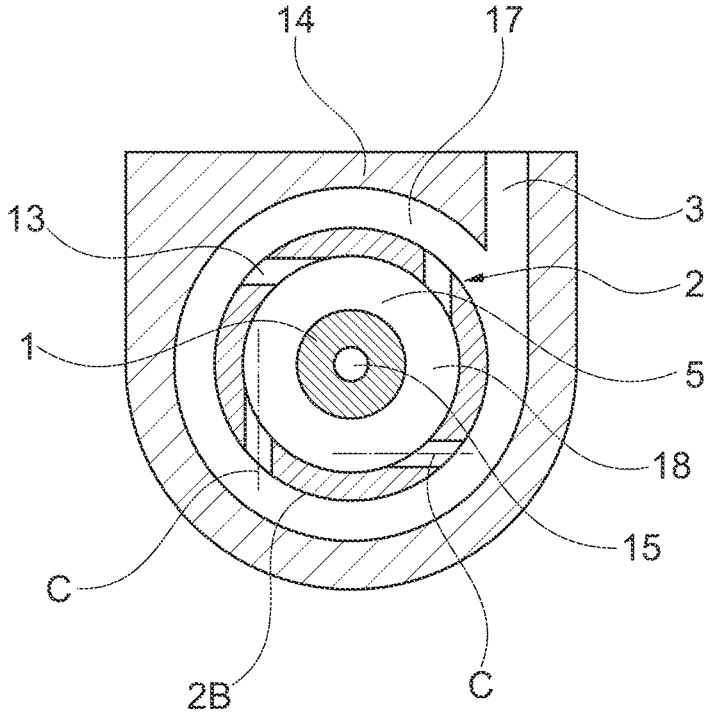
Figure 5:
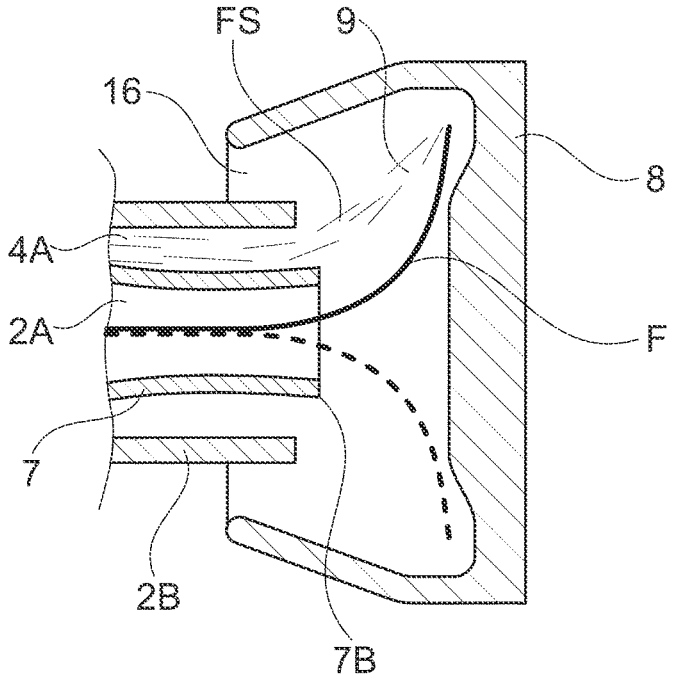
Figure 4:
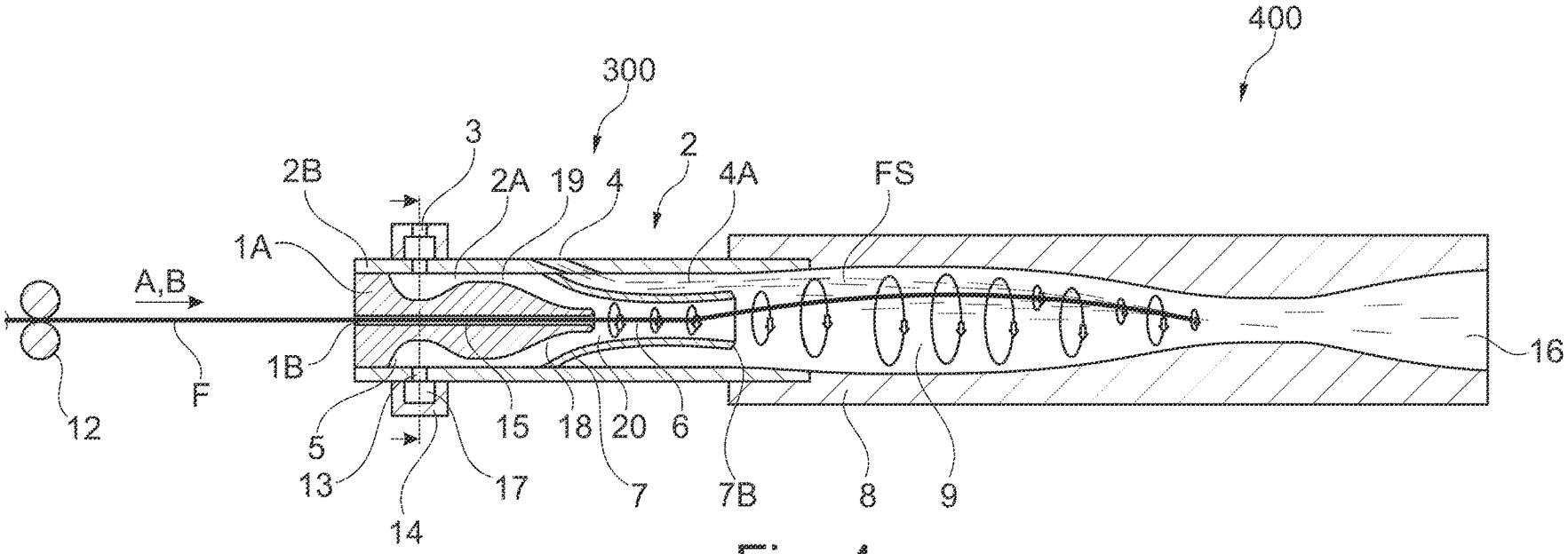
Figure 6:
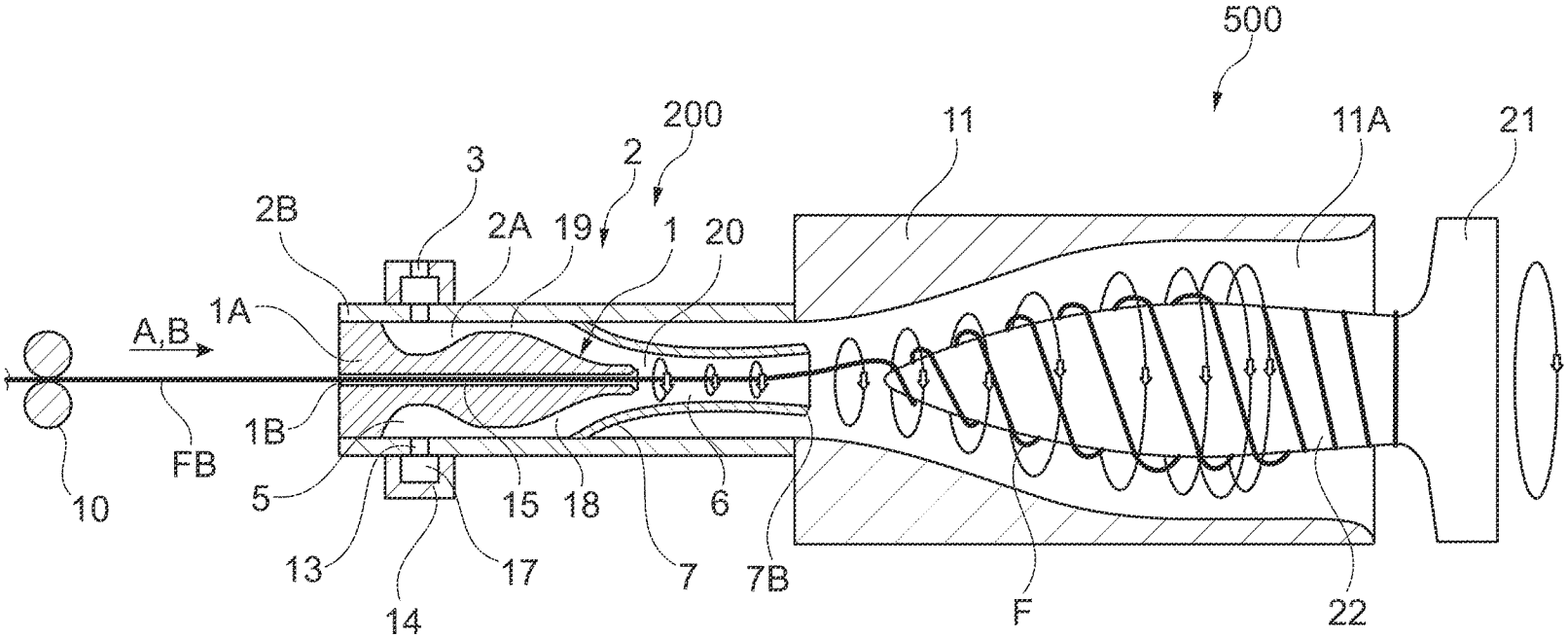
Figure 7:
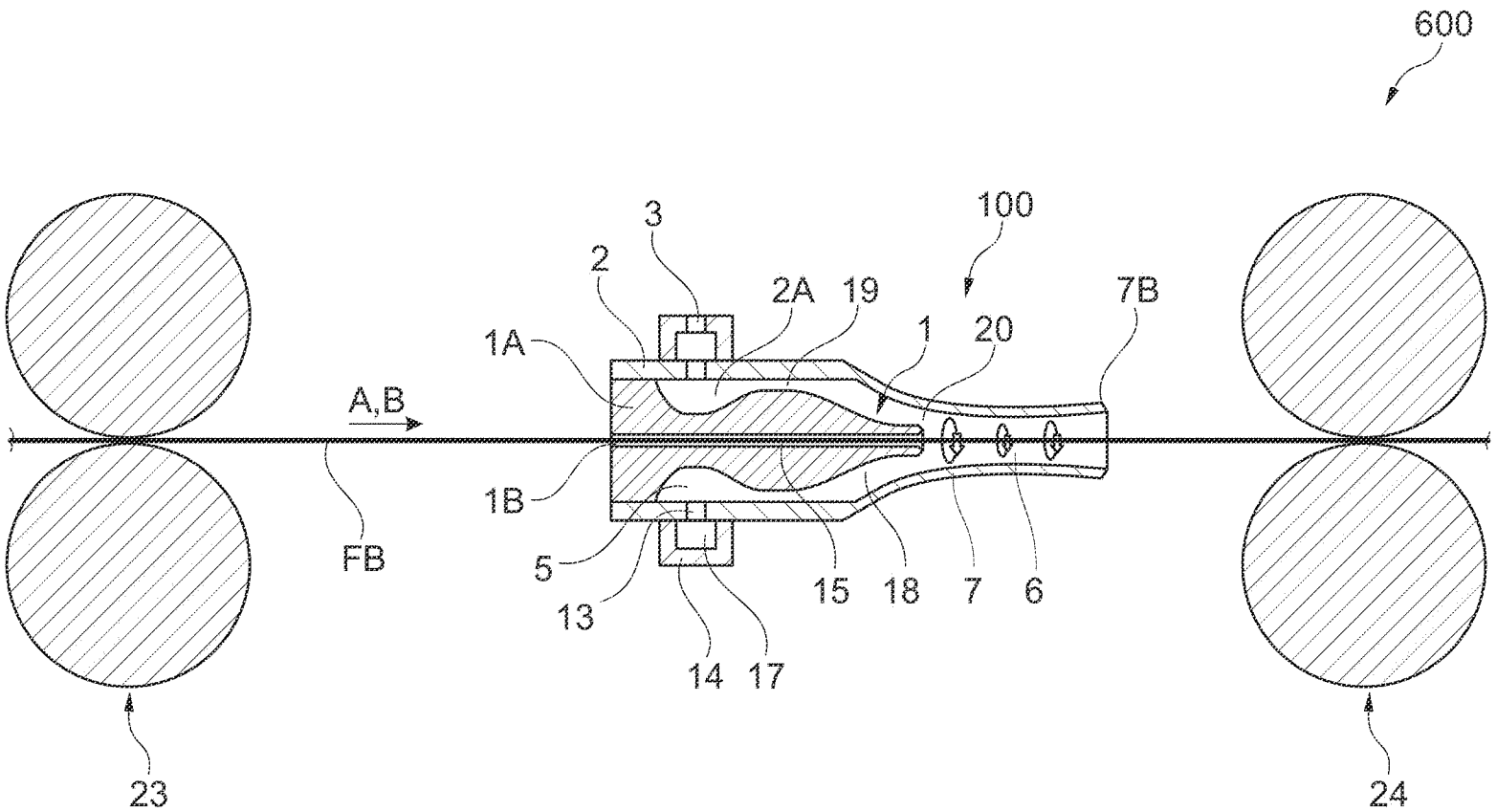

FIG. 1 is a schematic sectional view of a multifunctional nozzle according to a first embodiment example, FIG. 2 is a schematic sectional view of a multifunctional nozzle according to a second embodiment example, FIG. 3 is a schematic sectional view of the multifunctional nozzle according to one of the embodiment examples shown in FIG. 1 and FIG. 2 along section line A-A, FIG. 4 is a schematic sectional view of an open-end spinning device comprising a multifunctional nozzle according to a third embodiment example, FIG. 5 is a schematic sectional view of a spinning chamber according to an embodiment example for an open-end spinning device comprising a multifunctional nozzle according to a third embodiment example, FIG. 6 is a schematic sectional view of a spinning device comprising a multifunctional nozzle shown in FIG. 2, and FIG. 7 is a schematic sectional view of a drafting system device comprising a multifunctional nozzle shown in FIG. 1.

In the following description of embodiment examples, the same or similar reference signs are used for the elements shown in the various figures that have a similar action, in which case the descriptions of these elements are not repeated.

FIG. 1 is a schematic sectional view of a multifunctional nozzle 100 according to a first embodiment example. The multifunctional nozzle 100 comprises a nozzle housing 2 to which pressure can be applied and which comprises a nozzle channel 2A, which extends along the longitudinal axis direction A of the nozzle housing 2 and is open on one side along the longitudinal axis direction A. The nozzle housing 2 is a geometric hollow body, the cavity in which forms the nozzle channel 2A. According to this embodiment example, the nozzle housing 2 is made of a plastics-containing material and has a circular cross section orthogonally to its longitudinal axis direction A. The wall 2B of the nozzle housing 2 has a thickness and material composition that allow it to withstand a relatively long application of pressure by compressed air.

The nozzle housing 2 is formed having a compressed-air inlet 13 in the form of a fluid inlet for generating a vortex air flow in the nozzle channel 2A, the compressed-air inlet 13 extending in the nozzle channel 2A via the wall 2B having a fluid inlet mouth. The compressed-air inlet 13 is arranged inside a compressed-air chamber 17 of an antechamber housing 14 for the compressed-air feed. The antechamber housing 14 is arranged on the nozzle housing 2 and can be coupled to a compressed air source by means of a further compressed-air inlet 3. As shown in particular by FIG. 3 according to a preferred embodiment example, the antechamber housing 14 having the compressed-air chamber 17 extends annularly entirely around the nozzle housing 2 in order to be able to supply compressed air simultaneously to a plurality of compressed-air inlets 13 by means of the compressed-air chamber 17, which is likewise annular. Overall, according to this embodiment example, four compressed-air inlets 13 are formed on the nozzle housing 2 and are arranged in an evenly distributed manner circumferentially. Each of the four compressed-air inlets 13 has fluid inlet mouths, which are arranged, by their mouth axis C, in an orthogonal plane (FIG. 3, section line A-A) in relation to the longitudinal axis direction A in such a way that the compressed air can be admitted tangentially to the nozzle channel 2A. The tangentially oriented mouth axis C furthermore points in a direction facing the open end of the nozzle channel 2A while forming an angle of more than 0° and less than 90° with the orthogonal plane, thereby making it possible to generate an improved vortex air flow having reduced turbulence flows.

In the nozzle channel 2A, a nozzle body 1 is interchangeably inserted and has a through-duct 15, which extends along the longitudinal axis direction A, for guiding through a thread F or fibre band FB. The cross section of the through-duct 15 is suitably adapted, depending on the cross section of the thread F or fibre band FB being guided therethrough, to be able to guide the thread F or fibre band FB through the nozzle body 1. According to this embodiment example, the internal diameter of the through-duct 15 is adapted, in cross section, to the outer diameter of the thread F or fibre band FB being guided therethrough by being at least 3% and at most 25% larger in order to be able to ensure efficient and in particular unimpeded guidance of the thread F or fibre band FB.

The nozzle body 1 is shorter than the nozzle channel 2A along the longitudinal axis direction A, in which case the admitted compressed air can be guided in the nozzle housing 2 past a free end of the nozzle body 1 in order to be able to generate a suction flow in the through-duct 15.

At one end, the nozzle body 1 has a delimiting part 1A for arrangement in the nozzle channel 2A, in a manner closing the nozzle housing 2 axially on one side and thus delimiting the nozzle channel 2A axially on one side, in order to close the nozzle channel 2A remotely from the fluid inlet/compressed-air inlet 13. According to this embodiment example, the delimiting part 1A is formed in one piece with the nozzle body 1. The delimiting part 1A has a further through-duct 1B, extending along the longitudinal axis direction A, for the thread F or fibre band FB for communicating with the through-duct 15 of the nozzle body 1. The further through-duct 1B and the through-duct 15 are arranged coaxially along the longitudinal axis direction A and have the same cross-sectional shape.

According to an embodiment example that has not been shown, the delimiting part 1A can be configured as a separate component; in this case, the delimiting part can be arranged directly on the nozzle body 1 in such a way that the further through-duct 1B merges directly into the through-duct 15 and bears the nozzle body 1, in particular by means of an integral bond, frictional connection or interlocking.

Remotely from the delimiting part 1A, the nozzle body 1 forms an intermediate annular gap 18 together with the wall 2B of the nozzle housing 2 over the extension length of the nozzle body 1. The annular gap 18 extends in the nozzle channel 2A along the longitudinal axis direction A, having a first narrow point 19, towards which the annular gap 18 tapers on both sides along the longitudinal axis direction A and which is formed downstream of the compressed-air inlet 13 along the longitudinal axis direction A, and having a second narrow point 20 at the level of the free end of the nozzle body 1. According to this embodiment example, the annular gap 18 forms a nozzle up to the relevant first 19 and second narrow point 20, and a diffuser downstream of the first narrow point 19. In the region of the compressed-air inlet 13, a flow chamber 5 is thus formed in the annular gap 18, from which flow chamber a compressed-air flow propagates towards the first narrow point 19 once the compressed air has been admitted via the compressed-air inlet 13.

Downstream of the nozzle body 1 along the longitudinal axis direction A, there is a hollow-body-like flow conducting body 7 for guiding the thread F or fibre band FB, in a manner accompanied by fluid, between the annular gap 18 and the open end of the nozzle channel 2A, the flow conducting body 7 forming a rotation chamber 6 downstream of the nozzle body 1. In this embodiment example, the flow conducting body 7 is formed by the nozzle housing 2. FIG. 2 shows a multifunctional nozzle 200 according to a further embodiment example, which differs from the embodiment example described above in relation to FIG. 1 on account of the configuration of the flow conducting body 7. In the embodiment example shown in FIG. 2, the flow conducting body 7 is configured as a separate component that is coupled to the nozzle housing 2 in the nozzle channel 2A. For this purpose, a fixed end 7A is secured in the nozzle channel 2A on the inside of the wall 2B on the nozzle housing 2. The flow conducting body 7 extends from the fixed end 7A as far as to a free end 7B, which in the two embodiment examples simultaneously defines the open end of the nozzle channel 2A. According to both embodiment examples, the flow conducting body 7 is formed so as to be similar to a Laval nozzle in cross section along the longitudinal axis direction A.

By means of the multifunctional nozzle 100, 200 according to the above-described embodiment examples, a vortex air flow W can be generated once a pressurised fluid, in particular compressed air, has been admitted. Once the compressed air has been admitted via the compressed-air inlet 13, a flow circulating around the nozzle body 1 is generated in the flow chamber 5; due to the prevailing positive pressure and the delimiting part 1A, said flow is directed towards the first narrow point 19 in a manner circulating around the nozzle body 1. As per the principle of a nozzle, the vortex air flow W is accelerated past the first narrow point 19 and the second narrow point 20. At the free end of the nozzle body 1, the accelerated vortex air flow W generates a vacuum in the through-duct 15. By means of the vacuum, a suction flow is brought about in the through-duct 15 and is capable of introducing and pulling in a thread F or fibre band FB in the insertion direction B. The vortex air flow W passing by the second narrow point 20 and by the free end of the nozzle body 1 can rotate unimpeded within the free portion of the flow conducting body 7, said free portion being arranged downstream of the nozzle body 1 and defining the rotation chamber 6, and can propagate towards the open end of the nozzle channel 2A. In the process, the vortex air flow W is accelerated towards the open end of the nozzle channel 2A axially or, in other words, along the longitudinal axis direction A by the Laval nozzle-like cross-sectional shape of the flow conducting body 7.

In combination with the introduction of a thread F or fibre band FB, the thread F or fibre band FB introduced into the further through-duct 1B is sucked towards the rotation chamber 6 by means of the suction flow generated in the through-duct 15 and the further through-duct 1B when compressed air is fed in via the compressed-air inlet 13. At the same time, the guided thread F or the guided fibre band FB is set into a rotational motion about its longitudinal axis and about the axis of the insertion direction B or longitudinal axis direction A. The rotation about its own longitudinal axis is determined by a clamping point, located outside the multifunctional nozzle 100, 200 in the opposite direction to the longitudinal axis direction A, during the guidance of the thread or fibre band. For example, the thread F or fibre band FB can be clamped outside the multifunctional nozzle 100, 200 by means of a thread take-up device 12 or by means of a thread feed apparatus, as will be explained in more detail below on the basis of preferred embodiment examples.

Once the thread F or fibre band FB introduced into the multifunctional nozzle 100, 200 has left the nozzle body 1, it undergoes a rotation about the axis of the insertion direction B at a larger rotation diameter, which is limited by the internal diameter of the rotation chamber 6 or of the flow conducting body 7.

FIG. 4 is a schematic sectional view of an open-end spinning device 400 according to an embodiment example, comprising a multifunctional nozzle 300 according to a third embodiment example. In the multifunctional nozzle 300 according to the third embodiment example, the wall 2B of the nozzle housing 2 has, in addition to the multifunctional nozzle 200 according to the second embodiment example, an extension length along the longitudinal axis direction A that is such that the nozzle housing 2 protrudes beyond the free end 7B of the flow conducting body 7 along the longitudinal axis direction A. In addition, a fibre inlet 4 is formed in the wall 2B of the nozzle housing 2, downstream of the fixed end 7A of the flow conducting body 7 along the longitudinal axis direction A. The fibre inlet 4 opens in a space, which is formed between the flow conducting body 7 and the wall 2B of the nozzle housing 2 and defines a fibre duct 4A. The fibre inlet 4 can be coupled to a fibre feed apparatus, for example a fibre opening unit known from the rotor spinning machine field, in order to be able to feed opened or separated fibres FS to the multifunctional nozzle 300 via the fibre duct 4A.

An axial end of a spinning-chamber housing 8 is interchangeably linked to the nozzle housing end 2 by means of the wall 2B protruding beyond the flow conducting body 7 along the longitudinal axis direction A. In this preferred embodiment example, the coupling is implemented by means of an airtight press fit between the relevant mutually facing end faces of the nozzle housing 2 and the spinning-chamber housing 8; these can be detached and secured by being withdrawn and plugged along the longitudinal axis direction A in order to change the spinning-chamber housing 8. The spinning-chamber housing 8 has a cross-sectional shape similar to a Laval nozzle along the longitudinal axis direction A, the converging spinning-chamber housing segment downstream of the nozzle housing 2 along the longitudinal axis direction A forming a spinning chamber 9. In the diverging spinning-chamber housing segment, the spinning-chamber housing 8 comprises a fibre outlet 16 that can be connected to a vacuum source.

The open-end spinning device 400 comprises a thread take-up device 12, which is arranged along the thread travel path in order to take off, from the multifunctional nozzle 300, a thread F that has been air-spun by said multifunctional nozzle, in a controlled manner. In this embodiment example, the thread take-up device 12 is formed by means of a roller pair that can be driven in a defined manner. Alternatively, in an embodiment example that has not been shown, the thread take-up device 12 can be implemented, for example, by means of a winding device that is designed to wind up a take-up package, the winding up simultaneously bringing about the thread take-off. As a further alternative, the thread take-up device 12 can be implemented by a thread accumulator, by means of which a defined amount of thread can be stored. In particular, a thread accumulator of this kind favours continual spinning operation while a thread break is being remedied, for example by means of a thread splicing apparatus.

Using the open-end spinning device 400, an open-end spinning method can be carried out to generate a real twist yarn. For this purpose, in particular during a piecing process, a positive pressure first needs to be applied to the compressed-air inlet 3 to admit compressed air, and a vacuum needs to be applied to the fibre outlet 16. This can be done simultaneously or in a desired order. Next, a thread end of a thread F has to be presented to the multifunctional nozzle 300 at the further through-duct 1B or inserted into the further through-duct 1B in a defined manner. The applied positive pressure brings about a suction flow in the further through-duct 1B, via which the thread end can be reliably sucked into the further through-duct 1B or guided via the through-duct 15 of the nozzle body 1 as far as into the rotation chamber 6. The vortex air flow W generated by means of the positive pressure, in a manner favourably assisted by the vacuum, acts on the thread end introduced into the rotation chamber 6, as a result of which the thread end or the thread F is rotated and the thread end or the thread F is entrained along the longitudinal axis direction A. The fibre feed for feeding separated fibres FS is activated. The vacuum applied to the fibre inlet 4 or the applied suction flow brings about a feed of separated fibres FS from the fibre opening unit coupled to the fibre inlet 4. The separated fibres FS are rotationally entrained as far as into the spinning chamber 9 by the vortex air flow W at the end of the nozzle body 1. The thread end and the separated fibres FS can be fed either simultaneously or staggered in a desired order. The separated fibres FS can generally be fed continuously or in intervals, depending on requirements. As soon as the thread end and the fibres FS have arrived in the spinning chamber 9, accompanied by the vortex air flow W, the rotating separated fibres FS adhere to the thread end, which is likewise rotating, thereby producing a new air-spun thread section having a real twist without an internal untwisted core. Superfluous fibres FS are simultaneously carried away through the fibre outlet 16 by means of the applied vacuum. When a vacuum and a positive pressure are applied during the feed of the separated fibres FS, the thread F is drawn out of the multifunctional nozzle 300, in the opposite direction to the insertion direction B of the thread end, by means of the thread take-up device 12 at a take-off speed that allows separated fibres FS to constantly accumulate at the newly forming thread end in order to air-spin the thread F having a real twist.

FIG. 5 is a schematic sectional view of a spinning chamber 9 according to an embodiment example for an open-end spinning device 400 comprising a multifunctional nozzle 300 according to a third embodiment example. Transversely to the longitudinal axis direction A, the spinning chamber 9 has a cross-sectional shape similar to a rotor cup interior, having an internal diameter along which the mouths of the flow conducting body 7 of the fibre duct 4A and of the fibre outlet 16 are arranged for communicating with the spinning chamber 9. According to this embodiment example, the mouth of the flow conducting body 7 is arranged radially internally and coaxially with the spinning chamber 9 and has a circular cross section, the mouth of the fibre outlet 16 is arranged radially externally and has a cross section similar to an annular gap surrounding the mouth of the flow conducting body 7, and the mouth of the fibre duct 4A is arranged therebetween in the radial direction and has a cross section similar to an annular gap surrounding the mouth of the flow conducting body 7. The mode of action and operation of the spinning chamber 9 according to this preferred embodiment example is the same as in the above-described spinning chamber 9. Using a spinning chamber 9 of this kind, which is similar to a rotor cup interior in cross section, allows for a compact design and for the use of known and tried-and-tested rotor cup geometries.

FIG. 6 is a schematic sectional view of a spinning device 500 comprising a multifunctional nozzle 200 shown in FIG. 2. The spinning device 500 is associated with a fibre band feed 10, which, according to this embodiment example, is formed by an output roller pair of a drafting system device 600 for the defined drawing of the fibre band feed FB. The spinning device 500 comprises the multifunctional nozzle 200 according to the second embodiment example for receiving the drawn fibre band FB. A delimiting sleeve 11 is arranged downstream of the multifunctional nozzle 200 in an insertion direction B or feed direction of the fibre band FB, followed by a rotatably drivable spindle 21. The spindle 21 is configured to rotatably bear an empty tube 22, in particular so as to entrain it in a manner correlated with the direction of rotation of an vortex flow W generated in the multifunctional nozzle 200. The spindle 21 along with the empty tube 22 are together rotatably borne by a spindle rail (not shown). The spindle rail is configured to perform a linear stroke movement back and forth along the axis of rotation of the spindle 21 or of the empty tube 22, while entraining the spindle 21 together with the empty tube 22. For this purpose, the delimiting sleeve 11 comprises a cavity 11A, in which the empty tube 22 borne by the spindle 21 can be at least partly received in an upward end position of the stroke movement. The multifunctional nozzle 200 is connected to the delimiting sleeve 11 in such a way that the thread F generated by the multifunctional nozzle 200 can be seamlessly transferred from the nozzle channel 2A into the cavity 11A in order to enable winding of a defined winding region of the empty tube 22 during the stroke movement of the spindle rail, carried out relative to the delimiting sleeve 11, together with the rotation of the spindle 21 having the empty tube 22. The above-described construction is predominantly similar to a workstation of a ring spinning machine, apart from the fact that the multifunctional nozzle 200 having the delimiting sleeve 11 is used instead of a conventional ring traveller system. Replacing the ring traveller system favours the elimination of the physical limits imposed by that system, meaning that the thread F having a real twist can be generated at higher spinning speeds than in a conventional ring spinning machine, thus resulting in quicker winding of the empty tubes 22 and greater productivity.

FIG. 7 is a schematic sectional view of a drafting system device 600 comprising a multifunctional nozzle 100 shown in FIG. 1. The drafting system device 600 has a plurality of roller pairs 23, 24 in a fibre band transport direction, which corresponds to the longitudinal axis direction A of the multifunctional nozzle 100. As usual, each roller pair 23, 24 can be driven at a different rotational speed in order to draw, in a defined manner, the fibre band FB being transported by said roller pairs 23, 24. A corresponding drafting zone is thus formed between said roller pairs 23, 24. According to this embodiment example, the multifunctional nozzle 100 is arranged in the drafting zone between the two roller pairs 23, 24 to receive the fibre band FB from one roller pair 23 and forward it to the other roller pair 24. During operation of the drafting system device 600 and when a positive pressure is applied to the fluid inlet/compressed-air inlet 13, the fibre band FB guided through the multifunctional nozzle 100 undergoes a false spin, which increasingly strengthens in the fibre band transport direction as far as to a clamping region of the roller pair 24 arranged downstream of the multifunctional nozzle 100. The fibre band composite can be reliably compressed by means of the active twist, since any edge fibres sticking out can be readily bound into the fibre band composite and the fibre band composite undergoes efficient tapering or compacting in its width direction.

The embodiment examples described above and shown in the figures are only selected by way of example. Different embodiment examples can be combined with one another completely or with regard to individual features. An embodiment example can also be supplemented with features of a further embodiment example.

If an embodiment example has an "and/or" link between a first feature and a second feature, this should be understood to mean that the embodiment example according to one embodiment comprises both the first feature and the second feature and, according to a further embodiment, comprises either only the first feature or only the second feature.

| List of reference signs | |
|---|---|
| 1 | Nozzle body |
| 1A | Delimiting part |
| 1B | Further through-duct |
| 2 | Nozzle housing |
| 2A | Nozzle channel |
| 2B | Wall of the nozzle housing |
| 3 | Further compressed-air inlet |
| 4 | Fibre inlet |
| 4A | Fibre duct |
| 5 | Flow chamber |
| 6 | Rotation chamber |
| 7 | Flow conducting body |
| 7A | Fixed end of the flow conducting body |
| 7B | Free end of the flow conducting body |
| 8 | Spinning-chamber housing |
| 9 | Spinning chamber |
| 10 | Fibre band feed |
| 11 | Delimiting sleeve |
| 11A | Cavity in the delimiting sleeve |
| 12 | Thread take-up device |
| 13 | Compressed-air inlet |
| 14 | Antechamber housing |
| 15 | Through-duct |
| 16 | Fibre outlet |
| 17 | Compressed-air chamber |

-continued

| List of reference signs | |
|---|---|
| 18 | Annular gap |
| 19 | First narrow point |
| 20 | Second narrow point |
| 21 | Spindle |
| 22 | Empty tube |
| 23, 24 | Roller pair |
| 100, 200, 300 | Multifunctional nozzle |
| 400 | Open-end spinning device |
| 500 | Spinning device |
| 600 | Drafting system device |
| A | Longitudinal axis direction |
| B | Insertion direction of the thread or fibre band |
| C | Mouth axis |
| F | Thread |
| FB | Fibre band |
| FS | Fibre |
| W | Vortex air flow |

The invention claimed is:

1. A multifunctional nozzle for a spinning machine, comprising;

a pressurisable nozzle housing with a nozzle channel which extends along a longitudinal axis direction of the pressurisable nozzle housing and is open on one side along the longitudinal axis direction;

a fluid inlet for admitting a pressurised fluid into the nozzle channel to bring about a vortex flow within the nozzle channel;

a nozzle body designed to be arranged in the nozzle channel or to be formed in the nozzle channel together with the pressurisable nozzle housing, wherein the nozzle body is shorter than the nozzle channel along the longitudinal axis direction and has a through-duct which extends along the longitudinal axis direction for guiding through a thread or a fibre band;

an annular gap which extends in the nozzle channel along the longitudinal axis direction and has at least one narrow point towards which the annular gap tapers on both sides along the longitudinal axis direction, wherein the at least one narrow point is formed downstream of the fluid inlet along the longitudinal axis direction;

a delimiting part designed to be formed or arranged in the nozzle channel in a manner closing the pressurisable nozzle housing on a side of the fluid inlet that faces away from the at least one narrow point, wherein the delimiting part has a further through-duct extending along the longitudinal axis direction for the thread or the fibre band for communicating with the through-duct of the nozzle body; and a hollow-body-like flow conducting body designed to guide the thread or the fibre band in a manner accompanied by fluid between the annular gap and an open end of the nozzle channel;

wherein the annular gap is formed between the nozzle body and the pressurisable nozzle housing and/or the hollow-body-like flow conducting body.

2. The multifunctional nozzle according to claim 1, wherein the fluid inlet has at least two circumferentially distributed fluid inlet mouths which lead into the nozzle channel.

3. The multifunctional nozzle according to claim 1, wherein the delimiting part is formed by the nozzle body or bears the nozzle body.

4. The multifunctional nozzle according to claim 1, wherein the annular gap has an asymmetric hourglass cross-sectional shape along the longitudinal axis direction and/or the flow conducting body has an asymmetric hourglass cross-sectional shape along the longitudinal axis direction.

5. The multifunctional nozzle according to claim 1, wherein the nozzle body has a lachrymiform cross-sectional shape in a sectional plane running through a central longitudinal axis of the through-duct.

6. The multifunctional nozzle according to claim 1, wherein the flow conducting body is formed by a component that is separate from the pressurisable nozzle housing, said component having a fixed end which is coupled to the pressurisable nozzle housing at a spacing from the delimiting part and a free end which is formed on a side of the flow conducting body that faces away from the delimiting part.

7. The multifunctional nozzle according to claim 2, further including a fibre feed for feeding separated fibres, the fibre feed having a fibre inlet and a fibre duct which communicates therewith and is arranged downstream in a fibre transport direction, and a spinning chamber arranged downstream of the flow conducting body along the longitudinal axis direction, the flow conducting body and the fibre duct opening into the spinning chamber along the longitudinal axis direction, and the spinning chamber having a fibre outlet for discharging superfluous fibres, said fibre outlet being separate from the at least two circumferentially distributed fluid inlet mouths of the flow conducting body and of the fibre duct and being able to be coupled to a vacuum source.

8. The multifunctional nozzle according to claim 7, wherein the spinning chamber is formed by a spinning-chamber housing that is interchangeably coupled or able to be coupled to the pressurisable nozzle housing.

9. The multifunctional nozzle according to claim 8, wherein the pressurisable nozzle housing has a wall which delimits the fibre duct radially on an outside, protrudes beyond the flow conducting body towards the spinning chamber and comprises a coupling member for interchangeably coupling the spinning-chamber housing to the nozzle housing.

10. The multifunctional nozzle according to claim 7, wherein the spinning chamber has an asymmetric hourglass cross-sectional shape along a longitudinal axis thereof.

11. The multifunctional nozzle according to claim 7, wherein the spinning chamber along a longitudinal axis thereof has a cross-sectional shape with an outer ring having internal edges connected to a slanted ledge to an inner disc along which the at least two circumferentially distributed fluid inlet mouths of the flow conducting body of the fibre duct and of the fibre outlet are arranged for communicating with the spinning chamber.

12. An open-end spinning device for spinning a real-twist thread, comprising:

a spinning device for spinning the real-twist thread out of fed-in separated fibres;

wherein the spinning device comprises the multifunctional nozzle according to claim 7.

13. An open-end spinning method for producing a real-twist thread, comprising:

providing the multifunctional nozzle according to claim 8 as a spinning device;

admitting a pressurised fluid into the annular gap of the multifunctional nozzle through the fluid inlet in order to generate a vortex flow;

applying a vacuum to the fibre outlet of the spinning-chamber housing;

introducing a thread end of a thread, via the through-ducts of the delimiting part and of the nozzle body, as far as into the spinning chamber of the multifunctional nozzle;

admitting separated fibres into the multifunctional nozzle through the fibre inlet and the fibre duct; and when a vacuum and a positive pressure are applied during the feed of the separated fibres, drawing the thread out of the multifunctional nozzle in an opposite direction to an insertion direction of the thread end by a thread take-up device at a defined take-off speed.

14. A workstation of a spinning machine for spinning a real-twist thread, the workstation comprising:

a drafting system device for defined drawing of a fibre band fed to the drafting system device;

a spinning device for producing the real-twist thread from the drawn fibre band fed by the drafting system device;

a drivable spindle for bearing an empty tube in a manner rotatably entrained therewith, the drivable spindle along with the empty tube being rotatably borne by a spindle rail which is designed to execute a linear stroke movement back and forth along an axis of rotation of the drivable spindle or the empty tube while entraining the drivable spindle together with the empty tube; and a delimiting sleeve having a cavity in which the empty tube borne by the drivable spindle is at least partly received in an upward end position of the linear stroke movement;

wherein the spinning device is formed by the multifunctional nozzle according to claim 1, the multifunctional nozzle being arranged between the drafting system device and the delimiting sleeve in a fibre band transport direction so as to transfer the produced real-twist thread into the cavity for winding a winding region of the empty tube during the linear stroke movement performed relative to the delimiting sleeve.

15. A drafting system device comprising:

at least two roller pairs for defined drawing of a fibre band fed to the drafting system device, the at least two roller pairs being drivable at different rotational speeds from one another; and the multifunctional nozzle according to claim 1, the multifunctional nozzle being arranged in a fibre band travel path upstream, in a fibre band transport direction, of one of the at least two roller pairs.

16. The multifunctional nozzle according to claim 2, wherein the at least two circumferentially distributed fluid inlet mouths are arranged in an orthogonal plane with respect to the longitudinal axis direction and admit the pressurised fluid tangentially to the annular gap.

17. The multifunctional nozzle according to claim 6, wherein the flow conducting body is arranged coaxially with the pressurisable nozzle housing.

18. The multifunctional nozzle according to claim 6, wherein the free end has a smaller outer diameter than an outer diameter of the at least one narrow point.

* * * * *